US007731277B2

(12) United States Patent
Weber et al.

(10) Patent No.: US 7,731,277 B2
(45) Date of Patent: Jun. 8, 2010

(54) SEATING IMPLEMENT WITH TABLET

(75) Inventors: Reinhard Weber, Minden (DE); Friedrich Korte, Minden (DE); Paul Sprafke, Leonberg (DE)

(73) Assignee: VS Vereinigte Spezialmoebelfabriken GmbH & Co. KG, Tauberbischofsheim (DE)

( * ) Notice: Subject to any disclaimer, the term of this patent is extended or adjusted under 35 U.S.C. 154(b) by 0 days.

(21) Appl. No.: 12/038,370

(22) Filed: Feb. 27, 2008

(65) Prior Publication Data

US 2008/0203778 A1 Aug. 28, 2008

(30) Foreign Application Priority Data

Feb. 27, 2007 (DE) ..... 20 2007 002 863 U

(51) Int. Cl.
*A47C 7/70* (2006.01)

(52) U.S. Cl. ..... 297/162

(58) Field of Classification Search ..... 297/154, 297/160, 162, 173

See application file for complete search history.

(56) References Cited

U.S. PATENT DOCUMENTS

| | | | | | |
|---|---|---|---|---|---|
| 2,994,366 | A * | 8/1961 | Hoch | 248/230.1 |
| 3,368,842 | A * | 2/1968 | Polsky | 297/162 |
| 3,375,038 | A * | 3/1968 | Krueger | 297/160 |
| 3,567,277 | A | 3/1971 | Van Ryn | |
| 3,712,668 | A * | 1/1973 | Fink | 297/162 |
| 3,847,432 | A * | 11/1974 | Jennings | 297/160 |
| 4,159,846 | A * | 7/1979 | Tolleson | 297/162 |
| 5,765,911 | A * | 6/1998 | Sorenson | 297/173 |
| 5,893,607 | A | 4/1999 | Trimnell | |
| D417,342 | S * | 12/1999 | Holbrook | D6/341 |
| 6,634,717 | B2 * | 10/2003 | Kown | 297/446.2 |
| 6,669,282 | B2 | 12/2003 | Piretti | |
| 6,837,539 | B1 * | 1/2005 | Casey | 297/162 |

FOREIGN PATENT DOCUMENTS

| | | |
|---|---|---|
| DE | 2 050 322 | 4/1972 |
| DE | 298 19 878 U1 | 2/1999 |
| EP | 1 266 596 B1 | 2/2008 |
| NL | 1023669 C2 | 12/2004 |
| WO | 03015577 A1 | 2/2003 |

OTHER PUBLICATIONS

European Search Report dated Oct. 14, 2009.

* cited by examiner

*Primary Examiner*—Peter R. Brown
(74) *Attorney, Agent, or Firm*—Laurence A. Greenberg; Werner H. Stemer; Ralph E. Locher

(57) ABSTRACT

A seating implement has a base frame, a sitting surface, a back rest, and a tablet. The tablet is fastened to a support element provided on one side of the base frame by way of a linkage mechanism, so that the table can swivel between a substantially horizontal position of use and a position of non-use. The tablet is dimensioned to support a notebook computer and the support element has a section running in a substantially horizontal plane, on which the tablet is pivotally fastened by way of the linkage mechanism. The substantially horizontal section is oriented at an angle to the direction of the sitting surface, and the tablet can swivel about an axis substantially parallel to this section.

10 Claims, 3 Drawing Sheets

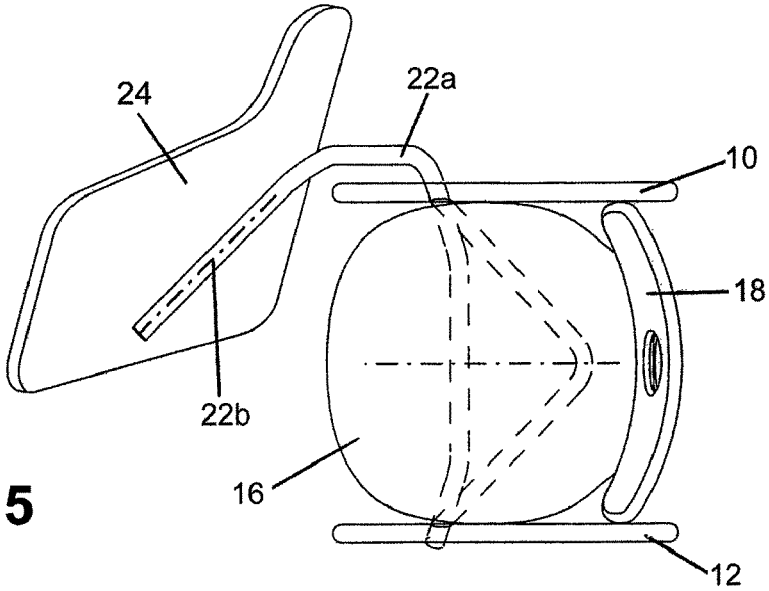
Fig. 5
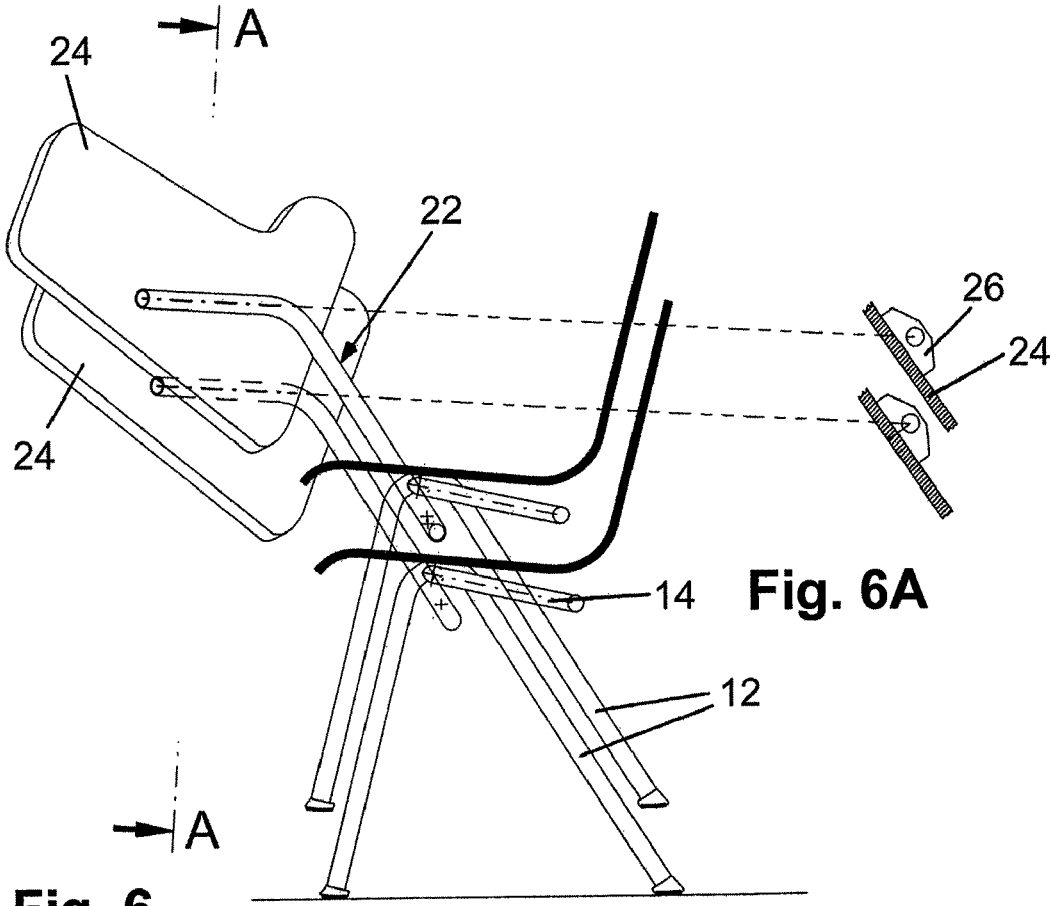
Fig. 6A
Fig. 6

SEATING IMPLEMENT WITH TABLET

CROSS REFERENCE TO RELATED APPLICATION

This application claims the priority, under 35 U.S.C. §119, of German application DE 20 2007 002 863.6, filed Feb. 27, 2007; the prior application is herewith incorporated by reference in its entirety.

BACKGROUND OF THE INVENTION

Field of the Invention

The present invention concerns a seating implement, such as a chair, with a tablet.

Such seating implements are used, for example, in the context of conferences or in lecture halls for student tables. They are known, for example, from the following prior art documents: German published patent application DE 20 50 322, German utility model DE 298 19 878 U1, European patent EP 1 266 596 B1, and U.S. Pat. No. 3,567,277. In such furniture, the tablets serve in particular as writing surfaces, being arranged on the side of the seating implement and able to swivel between a horizontal working position and a roughly vertical unused position. The swivel axis of the tablet usually runs parallel to the sitting direction of the seating implement.

For modern classrooms etc., there is now a need for a seating implement that also offers a working surface for a notebook computer or the like. The fold-down side tablets of traditional seating implements are not suited for this purpose, due to their dimensions being too small and their stability being too low. One approach to a solution, therefore, consists in providing a seating implement with a firm, i.e., not swiveling, side tablet of appropriate size. But this has the drawback of too narrow, and thus an uncomfortable entry and exit, which is impeded by the side tablet in its firm position of use.

SUMMARY OF THE INVENTION

It is accordingly an object of the invention to provide a chair with a folding tablet which overcomes the above-mentioned disadvantages of the heretofore-known devices and methods of this general type and which provides for a seating implement with a side tablet that offers a working surface suitable for a notebook computer, yet assures a comfortable entry and exit from the seating implement.

With the foregoing and other objects in view there is provided, in accordance with the invention, a seating implement, comprising:

a base frame, a sitting surface mounted to the base frame and defining a forward direction, and a back rest mounted to the base frame;

a support element mounted laterally to a side of the base frame, the support element including a section running in a substantially horizontal plane;

a tablet pivotally mounted by way of a linkage mechanism to the support element between a substantially horizontal position of use and a position of non-use;

the tablet being dimensioned to support a notebook computer, and the tablet being fastened, by way of the linkage mechanism, to the substantially horizontal section of the support element, the substantially horizontal section enclosing a given angle with the forward direction of the sitting surface, and the tablet being pivotable about an axis substantially parallel to the substantially horizontal section.

In other words, the objects of the invention are achieved with a seating implement that has a base frame (generally comprising several chair legs), a seating surface, a back rest, and a tablet. The tablet is fastened to a support element provided on one side of the base frame by way of a linkage mechanism, so that it can swivel between a substantially horizontal position of use and a position not in use. According to the invention, the tablet is dimensioned to support a laptop or notebook computer; and the support element has a section running in an substantially horizontal plane, on which the tablet is fastened by means of the linkage mechanism and can swivel, this section being oriented at an angle to the direction of the sitting surface, and the tablet can swivel about an axis substantially parallel to this section.

The terms notebook computer and laptop computer are used interchangeably to convey the same meaning.

The tablet is dimensioned to support a notebook computer or the like, i.e., accordingly larger in surface than the traditional fold-down side tablet. Furthermore, the support element for the tablet has a section running substantially in a horizontal plane, on which the tablet is fastened and can swivel by means of the linkage mechanism, this section being oriented at an angle to the sitting direction of the seating implement, and the tablet can swivel about an axis substantially parallel to this section. In this design, the tablet can be swung forward in front of the sitting surface at a slant to the direction of the sitting surface into its position not in use, so that a sufficiently wider and thus more comfortable entry and exit is created for the seating implement. The section of the support element slanting relative to the direction of the sitting surface extends far beneath the tablet and in this way achieves a large support for the entire surface of the tablet, which is advantageous for the larger weight of a notebook computer as compared to writing utensils. Furthermore, a user on the seating implement is not impeded by the larger dimensioned tablet as compared to a tablet folding down at the side in traditional manner, even when the tablet is folded down into its position of not in use.

In one embodiment of the invention, the angle between the section of the support element supporting the tablet and the direction of the sitting surface of the seating implement lies in a range of around 35 to 60 degrees, preferably 40 to 50 degrees.

In another embodiment of the invention, the support element is integrated in the base frame, for example, it makes a single piece with it or is welded to it.

The support element is preferably a tubular or rodlike support element.

In yet another embodiment of the invention, the linkage mechanism has a turn limiting device to limit the swiveling motion of the tablet between its position of use and its position of not in use. The position of the tablet not in use is swiveled by more than 90 degrees relative to its position in use, preferably by around 120 to 140 degrees.

Other features which are considered as characteristic for the invention are set forth in the appended claims.

Although the invention is illustrated and described herein as embodied in a seating implement with a tablet, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE SEVERAL VIEWS OF THE DRAWING

FIG. 5 is a schematic top view of the seating implement of FIG. 1, analogous to FIG. 3, with the tablet in its position not in use;

FIG. 6 is a schematic side view of a stacked arrangement of seating implements of FIG. 1; and FIG. 6A is an enlarged sectional view along the line A-A in FIG. 6.

DETAILED DESCRIPTION OF THE INVENTION

Figure 1:
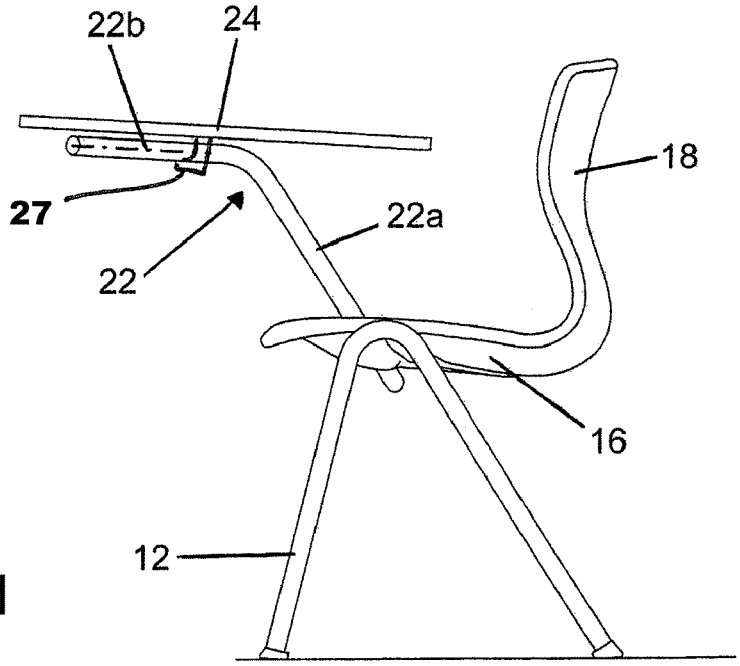
FIG. 1 is a schematic side view of a seating implement according to an exemplary embodiment of the present invention, with the tablet in its position of use.
Figure 2:
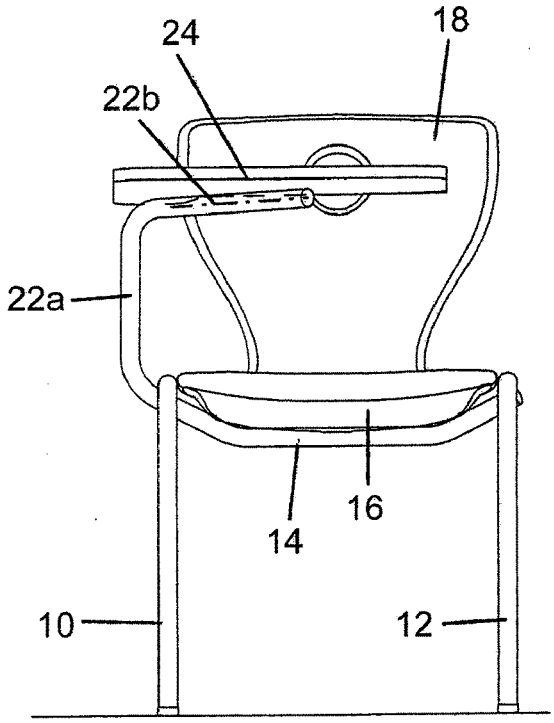
FIG. 2 is a schematic front view of the seating implement of FIG. 1, with the tablet in its position of use.
Figure 3:
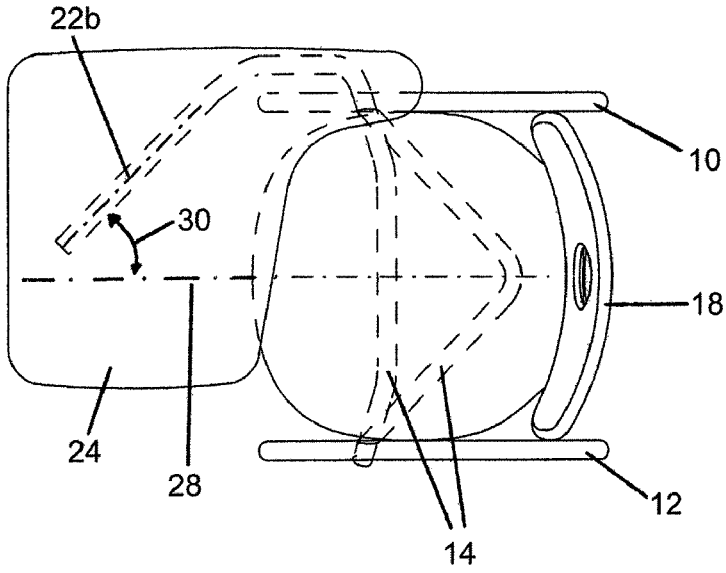
FIG. 3 is a schematic top view of the seating implement of FIG. 1, with the tablet in its position of use.
Figure 4:
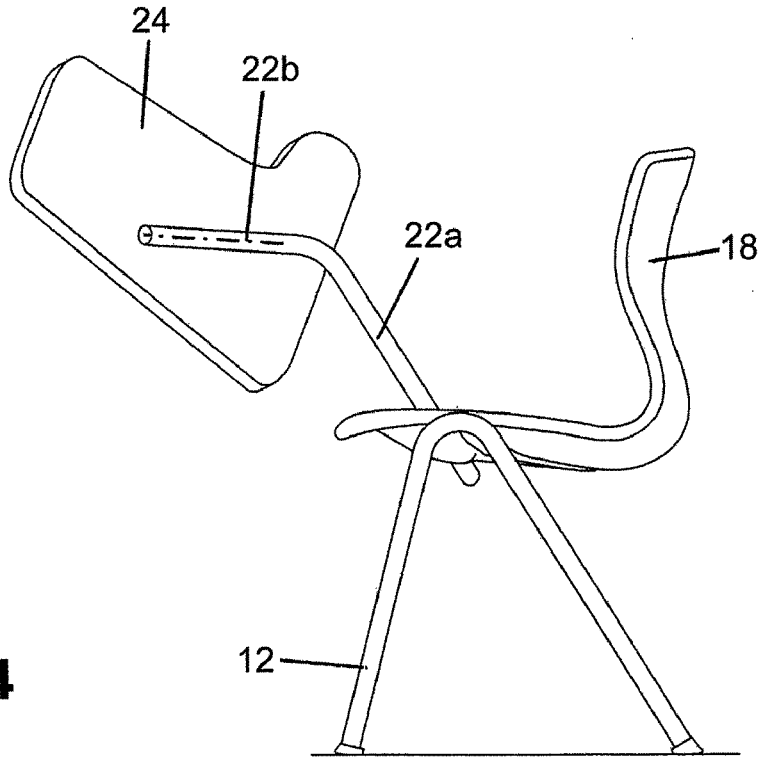
FIG. 4 is a schematic side view of the seating implement of FIG. 1, analogous to FIG. 1, with the tablet in its position not in use.

Referring now to the figures of the drawing in detail, a preferred embodiment of a seating implement with side tablet shall explained with reference to the enclosed drawings. FIGS. 1 to 3 show the seating implement in different views with the tablet in its position of use; FIGS. 4 and 5 show the seating implement in different views with the tablet in its position not in use; and FIG. 6 finally illustrates the possibility of stacking several such seating implements.

The seating implement, especially a chair, basically consists of a base frame 10-14, a sitting surface 16, a back rest 18 and a fold-down tablet 24. The base frame 10-14 of the seating implement in this exemplary embodiment comprises a right side cheek 10 with two chair legs, a left side cheek 12 with two chair legs, and at least one cross member 14, which joins the right and left side cheeks 10, 12 to each other and serves as a support beam for the sitting surface 16. The right and left side cheeks 10, 12 are configured and dimensioned such that several such chairs can be stacked one on top of another, as illustrated in FIG. 6, discussed hereafter.

The present invention, of course, is not merely limited to the embodiment of the seating implement represented in the figures; those of skill in the art will be able to easily recognize many changes and modifications. In particular, the seating implement of the invention is not limited to this special construction of base frame 10-14, sitting surface 16 and back rest 18. For example, in place of the side cheeks 10, 12, four separate chair legs can also be provided, which are joined together by suitable lengthwise and transverse members. Whereas in the illustrated exemplary embodiment the sitting surface 16 and back rest 18 are designed as a single piece, it is of course also possible to design the sitting surface 16 and back rest 18 separate from each other. In this case, an additional support member is required for the separate back rest 18. Moreover, the materials for the base frame 10-14, the sitting surface 16 and back rest 18 are substantially free to choose; in a preferred embodiment, however, the base frame is made from metal, and the sitting surface 16 and back rest 18 are made of plastic or wood.

On one side of the chair (the right side in this exemplary embodiment), a tubular or rod-shaped support element 22 for the tablet 24 is provided. The support element 22 is preferably integrated with the base frame 10-14; for example, the support element 22 is welded to the right side cheek 10 or one of the transverse members 14 (or alternatively configured integrally as a single piece with them).

The support element 22 has a first section 22*a* which runs forward and upward at a slant in a plane substantially parallel to the plane of the right side cheek 10 on the side of the sitting surface away from the latter. The upper end of this first section 22*a* determines the height of the tablet 24 in its position of use (see FIG. 1 to 3). This first section 22*a* is adjoined (directly or through intermediate sections, as one chooses) by a second section 22*b* of the support element 22, which runs in a substantially horizontal plane (see FIGS. 1 and 2) and at an angle 30 to a direction of the sitting surface 28 of the seating implement (see FIG. 3), referred to as a forward direction 28. The angle 30 between the second section 22*b* of the support element 22 and the direction of the sitting surface 28 (or the lengthwise axis) of the chair lies in a range of around 35 to 60 degrees, preferably around 40 to 50 degrees.

The tablet 24 is fastened by a linkage mechanism 26 (see FIG. 6A) to the second section 22*b* of the support element 22 so that it can pivot or swivel about an axis substantially parallel to the second section 22*b* between the horizontal position of use (see FIG. 1 to 3) and a storage position, when it is not in use (FIGS. 4 and 5).

The linkage mechanism 26 has a turn limiting device 22*c* (see FIG. 1), in order to limit the pivoting movement of the tablet 24 between its position of use and its position of non-use. The position of the tablet 24 not in use is preferably pivoted forward, i.e., in the direction away from the sitting surface 16 and back rest 18, by more than 90 degrees, preferably by around 120 to 140 degrees, with respect to its horizontal position of use. In this way, the tablet 24 is not oriented exactly vertically in its position not in use (see FIGS. 4 and 5), so that several such chairs can also be stacked one on top of the other, as illustrated in FIGS. 6 and 6A. The optimal swivel angle of the tablet 24 depends, in particular, on the dimensions of the tablet 24 and the stacking interval of the chairs.

The tablet 24 is dimensioned so that it can serve as a work surface for a notebook computer or the like. The slanted second section 22*b* of the support element 22 extends far underneath the tablet 24 and thus achieves a large support for the entire tablet 24, so that this can also bear the greater weight of a notebook computer. In the folded down position not in use of the tablet 24, the chair offers a sufficiently large and thus comfortable entry and exit, as illustrated in FIGS. 4 and 5. Since the tablet 24 is folded down forward at a slant, neither does a user sitting on the seating implement feel constricted by the larger dimensioned tablet 24, as would be the case with the conventional side-folding tablets.

Although not shown more precisely in the figure, the linkage mechanism 26 is designed as follows, for example. The linkage mechanism consists of two shells, the first shell being fastened to the underside of the tablet 24, for example, by screws, and is provided with a seating implement for the tubular second section 22*b* of the support element 22. For installation, the second section 22*b* of the support element 22 is first inserted into this seating implement and thereby pre-adjusted.

Next, the second section 22*b* of the support element 22 is received by the second shell of the linkage mechanism in sandwich style between the two shells, being able to turn, so as to enable the swivel motion of the tablet 24, and the second shell is fastened to the first shell or directly to the tablet (for example, by screws). The linkage mechanism 26 with the second section 22*b* of the support element 22 received therein is preferably covered by an additional housing shell, in order to avoid risk of injury.

The turn limiting device 22*c*, which is indicated highly schematically in FIG. 1, of the linkage mechanism 26 is constructed, for example, from a pin on the first shell and a groove on the second section 22*b* of the support element 22, while the length and the positioning of the groove defines the two end positions of the tablet 24.

The invention claimed is:

1. A seating implement, comprising:

a base frame, a sitting surface mounted to said base frame and defining a forward direction, and a back rest mounted to said base frame;

a support element mounted laterally to a side of said base frame, said support element being integrated with said base frame in a permanently fixed position relative to said base frame, said support element including a skewed section running in a substantially horizontal plane and being skewed at a permanently fixed angle relative to the forward direction of said sitting surface;

a tablet pivotally mounted by way of a linkage mechanism to said support element between a substantially horizontal position of use and a position of non-use;

said tablet being dimensioned to support a notebook computer, and said tablet being fastened, by way of said linkage mechanism, to said skewed section of said support element, and said tablet being pivotable about an axis substantially parallel to said skewed section.

2. The seating implement according to claim 1, wherein the permanently fixed angle lies in a range from approximately 35 to approximately 60 degrees.

3. The seating implement according to claim 1, wherein the permanently fixed angle lies in a range from 40 to 50 degrees.

4. The seating implement according to claim 1, wherein said support element is a tubular or rod-shaped support element.

5. The seating implement according to claim 1, wherein said linkage mechanism includes a turn limiting device configured to limit a swiveling motion of said tablet between the position of use and the position of non-use.

6. The seating implement according to claim 5, wherein the position of non-use is pivoted by more than 90 degrees relative to the position of use.

7. The seating implement according to claim 6, wherein the position of non-use is pivoted by more than around 120 to 140 degrees relative to the position of use.

8. A seating implement, comprising:

a base frame, a sitting surface mounted to said base frame and defining a forward direction, and a back rest mounted to said base frame;

a support element mounted laterally to a side of said base frame, said support element being integrated with said base frame in a permanently fixed position relative to said base frame, said support element including a substantially horizontal skewed section skewed at a permanently fixed angle relative to the forward direction of said sitting surface;

a tablet pivotally mounted by way of a linkage mechanism to said support element between a substantially horizontal position of use and a position of non-use;

said tablet being dimensioned to support a notebook computer, and said tablet being fastened, by way of said linkage mechanism, to said substantially horizontal skewed section of said support element and said tablet being pivotable about an axis substantially parallel to said substantially horizontal skewed section;

said linkage mechanism including a turn limiting device configured to limit a pivoting motion of said tablet between the position of use and the position of non-use.

9. A seating implement, comprising:

a base frame, a sitting surface mounted to said base frame and defining a forward direction, and a back rest mounted to said base frame, said base frame including at least one cross member below said seating surface;

a support element mounted laterally to a side of said base frame, said support element being integrated with said base frame in a fixed position, said support element being directly connected to said at least one cross member, and said support element including a skewed section running in a substantially horizontal plane and being skewed at a given angle relative to the forward direction of said sitting surface;

a tablet pivotally mounted by way of a linkage mechanism to said support element between a substantially horizontal position of use and a position of non-use;

said tablet being dimensioned to support a notebook computer, and said tablet being fastened, by way of said linkage mechanism, to said skewed section of said support element, and said tablet being pivotable about an axis substantially parallel to said skewed section.

10. The seating implement according to claim 9, wherein said cross member is a support beam for said seating surface.

* * * * *